US006983859B2

(12) United States Patent
Azzarello

(10) Patent No.: US 6,983,859 B2
(45) Date of Patent: Jan. 10, 2006

(54) CHILD PROOF AND TAMPER EVIDENT CONTAINER

(75) Inventor: Francis T. Azzarello, Woodstock, IL (US)

(73) Assignee: U.S. Can Company, Lombard, IL (US)

( * ) Notice: Subject to any disclaimer, the term of this patent is extended or adjusted under 35 U.S.C. 154(b) by 22 days.

(21) Appl. No.: 10/288,059

(22) Filed: Nov. 5, 2002

(65) Prior Publication Data

US 2003/0085227 A1 May 8, 2003

Related U.S. Application Data

(60) Provisional application No. 60/338,762, filed on Nov. 5, 2001.

(51) Int. Cl.
*B65D 41/04* (2006.01)

(52) U.S. Cl. ..... 220/288; 220/266; 220/298; 220/302; 220/324; 220/326; 215/216; 215/221; 215/253

(58) Field of Classification Search ..... 220/288, 220/266, 784, 788, 298, 300, 301, 302, 325, 220/326, 281, 324, 286, 783, 787, 794; 215/201, 215/213, 214, 217, 221, 223, 250, 253, 305
See application file for complete search history.

(56) References Cited

U.S. PATENT DOCUMENTS 4,198,040 A * 4/1980 Colasent ..... 220/254.4
4,540,098 A * 9/1985 Luker ..... 215/216
4,548,329 A * 10/1985 Curry ..... 215/216
4,630,743 A * 12/1986 Wright ..... 215/216
4,658,980 A 4/1987 Lindstrom
4,682,707 A 7/1987 Wiles
4,723,686 A * 2/1988 Pennisi ..... 220/300
4,732,288 A * 3/1988 Morris, Sr. ..... 215/214
4,905,861 A * 3/1990 Boxall et al. ..... 220/266
4,967,926 A * 11/1990 Morris, Sr. ..... 220/323
5,078,288 A * 1/1992 Fuchs ..... 215/209
5,513,770 A * 5/1996 Seeley et al. ..... 220/729
5,671,856 A * 9/1997 Lisch ..... 220/4.27
5,676,273 A * 10/1997 Jonkers et al. ..... 220/293
5,706,963 A * 1/1998 Gargione ..... 215/219
5,735,427 A * 4/1998 Hunter et al. ..... 220/324
5,865,330 A * 2/1999 Buono ..... 215/216
6,036,036 A * 3/2000 Bilani et al. ..... 215/216
6,039,196 A * 3/2000 Ekkert et al. ..... 215/216
6,402,798 B1 * 6/2002 Kallsen et al. ..... 55/385.3

* cited by examiner

*Primary Examiner*—Lee Young
*Assistant Examiner*—James Smalley
(74) *Attorney, Agent, or Firm*—Polster, Lieder, Woodruff, Lucchesi

(57) ABSTRACT

A child proof and tamper evident container (C) includes a pail (10) and a screw top cover (12) screwed onto the top of the pail to enclose contents of the pail. A latching mechanism (18) is formed on the pail. A plurality of tamper evident tabs (26) and second a child proof tab (14) are formed on the cover. Both types of tabs means engage the latching mechanism as the cover is screwed onto the pail. The one tab provides an indication as to whether or not the contents of the container have been tampered with, and the second tab prevents a child from removing the cover and opening the container.

10 Claims, 3 Drawing Sheets

CHILD PROOF AND TAMPER EVIDENT CONTAINER

CROSS REFERENCE TO RELATED APPLICATIONS

This invention relates to the provisional application assigned Ser. No. 60/338,762 which was filed on Nov. 5, 2001.

STATEMENT REGARDING FEDERALLY SPONSORED RESEARCH OR DEVELOPMENT

N/A

BACKGROUND OF THE INVENTION

This invention generally relates to plastic containers and covers therefore; and more particularly, to a container and cover having a plurality of tabs which make the container and cover both child resistant and tamper evident.

Containers have long been provided with childproof features that make it difficult, if not impossible, for a child to open a container. In one prior art construction, a screw top cover for a pail includes a tab having an integral projection forming part of the skirt of the cover. Four triangular shaped, raised projections are formed at equally spaced intervals around the rim of the pail. As the cover is screwed down onto the top of the pail, the tab is pressed inwardly for the projection formed by the tab to slide behind one of the four projections formed on the pail. The design of the cover is such that when completely screwed down, the projection formed by the tab on the cover stops slightly beyond one of the projections formed on the pail. The cover tab now springs back so it has a vertical edge abutting the edge of the adjacent projection formed on the top of the pail. This prevents the cover from now being unscrewed unless the tab on the cover is depressed inwardly as the cover is rotated off the top of the pail. Such an operation is readily easy for adults to understand and perform, but not children. The above described construction, however, has drawbacks. The clearance between the tab on the cover and projection on the pail, when the cover is screwed down, is important. If the tab extends too far past a projection, it means the threads on the cover and pail are not properly engaged and leakage may occur. If the tab does not extend far enough, the threads may be too tight. In this circumstance, the cover may not properly close allowing a child to open it. Since many plastic containers are filled with hazardous materials, the potential for danger is increased.

Besides child resistance, containers have also been provided with tamper evident features that make evident if the container has been previously opened. Tamper evident features can, for example, prevent the addition of foreign substances to the container's normal contents. It has been reported, for example, that someone will steal an expensive item such as a watch by placing it in a container holding a relatively cheap, bulk material such as pool chemicals. At the check out counter, the thief pays only for the cheap bulk material. More seriously, people have been known to add various types of contaminants to a container. The contaminant can then cause serious injury, or death, if unknowingly mixed with other chemicals, or if a person ingests, or is exposed to the contaminant.

There have been other approaches to providing tamper evident and child proof containers. U.S. Pat. No. 4,930,656, for example, teaches a removable tear strip for a plastic cover. The strip seals the cover to the top of a container prior to its sale. The customer then tears off the strip before opening the container. U.S. Pat. No. 5,310,074 teaches a screw top container having a hidden locking mechanism that prevents children from removing the top. However, there is no provision for indicating if there has been tampering with the container. U.S. Pat. No. 5,915,575 teaches a screw top container having a locking mechanism incorporated into a cover for the container. The mechanism includes a lever pivotable about a vertical axis. While the mechanism makes it difficult for children to open the container, there is nothing to indicate if tampering has occurred. Finally, U.S. Pat. No. 6,006,942 is for a container with a locking mechanism having a lever pivotable about a horizontal axis. While resistant, there is again no provision of something to indicate tampering.

BRIEF SUMMARY OF THE INVENTION

The present invention is directed to an improved container having both child proofing features and tamper evident features. The container includes a pail having a threaded opening at its upper end and a screw top cover correspondingly threaded for the cover to be screwed onto the top of the pail and enclose contents of the pail. A latching mechanism formed on the pail includes a plurality of triangular shaped tabs located at spaced intervals around the periphery of the top of the pail. First and second tabs are formed on the cover both tabs engaging the latching mechanism as the cover is screwed onto the pail. The first tab provides an indication as to whether or not the contents of the container have been tampered with. The second tab prevents a child from removing the cover and opening the container.

In a preferred embodiment of the invention, there is at least one of the first tabs formed on the cover for providing an indication of tampering. To remove the cover from the container requires the end user to depress both tabs at the same time. Because of the size of the cover, and spacing of the tabs, this is physically impossible for most people to do. Rather, to remove the cover, the person will tear off the tab or tabs. However, absence of the tabs is readily apparent and provides an immediate indication of tampering prior to a sale or use of the container. Since the containers are typically sold in retail establishments, containers which have been tampered with are readily identified while still in inventory, or at the point of sale. Containers which have been tampered with can thus be removed before anyone is harmed. After the sale, prior to the first use, the tamper evident tabs are removed. However, the other tab, which prevents a child from opening the container remains in place so children cannot open the container.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
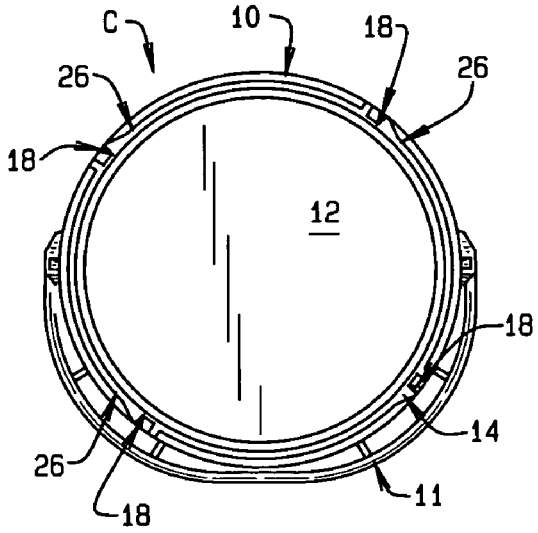
FIG. 1 is a top plan view of a tamper evident container and screw top cover of the present invention.

Referring to the drawings, in FIG. 1, a tamper evident and child proof container C of the present invention is shown to include a screw top pail 10 having an integrally formed bail 11, and a separate locking cover 12. Container C typically includes chemicals or powdered material which can harm a child. Also, the contents of the container may be such that if unauthorized persons have access to the contents, it is important that this be immediately known. In accordance with the present invention, both situations are addressed by the design and construction of the pail and its cover.

Figure 2:
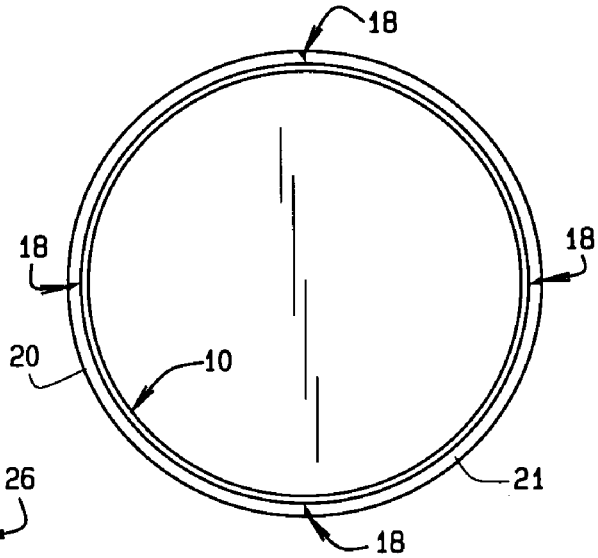
FIG. 2 is a top plan view of the container with the cover removed.
Figure 3:
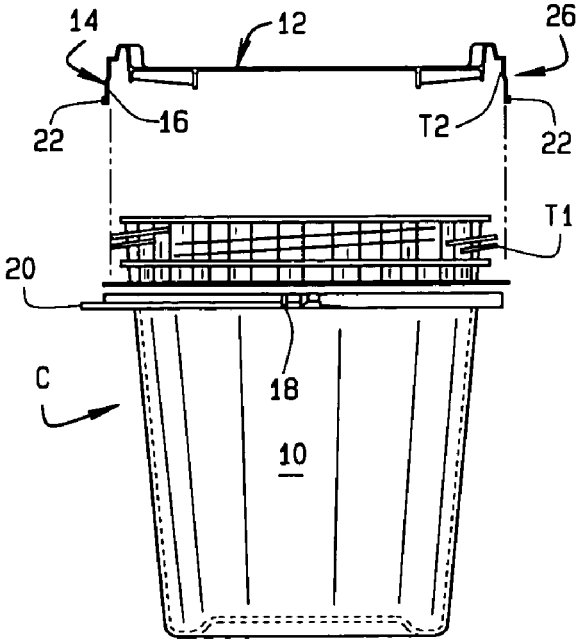
FIG. 3 is an elevation view, partly in section, of the container and its cover.

Pail 10 and cover 12 are both made of a molded plastic material. The open, top end of pail 10 is threaded about its outer surface as indicated at T1. Cover 12 is correspondingly threaded as indicated at T2 so the cover can be conveniently used to close and seal the container. A child proof feature of the container is provided by a tab 14 integrally formed with cover 12 as part of a skirt 16 of the cover. Child proofing and tamper proofing is further facilitated by a latching means which includes a plurality of triangular shaped locking tabs 18 which, as shown in FIG. 2 are equally spaced around a rim 20 of pail 10. Each tab 18 projects inwardly from the outer edge of rim 20 across a channel 21 formed in the top of the pail though which the threaded portion of cover 12 rotates when the cover is screwed down onto the pail. While four tabs 18 are shown in FIG. 2, those skilled in the art will recognize that other numbers of tabs can be used without departing from the scope of the invention.

Figure 4A:
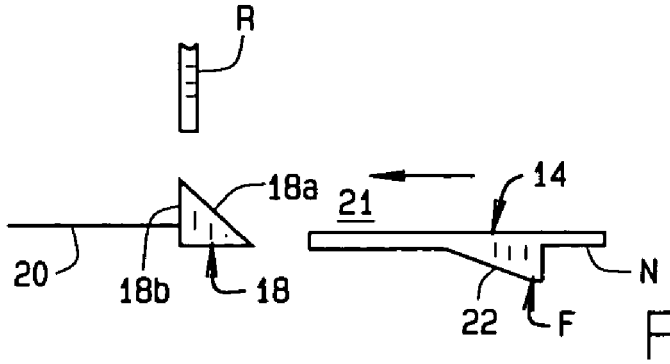
FIGS. 4*a*–4*c* are a series of plan views sequentially illustrating how the cover is screwed onto the top of the container.
Figure 4B:
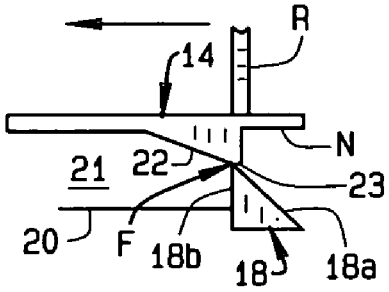
Figure 4C:
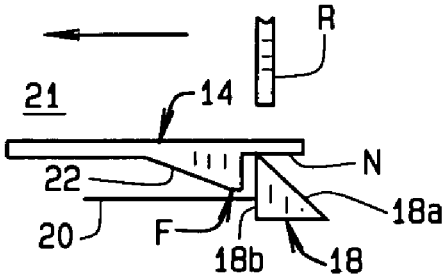
Figure 4D:
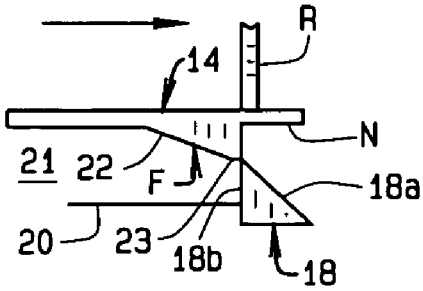
FIG. 4*d* illustrates how the cover must be moved in the opposite direction to open the cover.
Figure 4E:
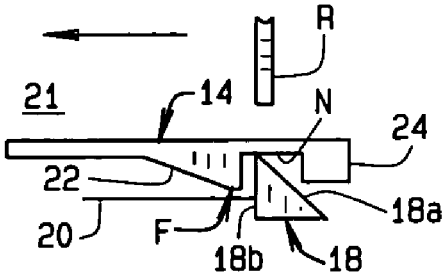
FIG. 4*e* illustrates how a tamper evident tab of the cover is locked in place.
Figure 5:
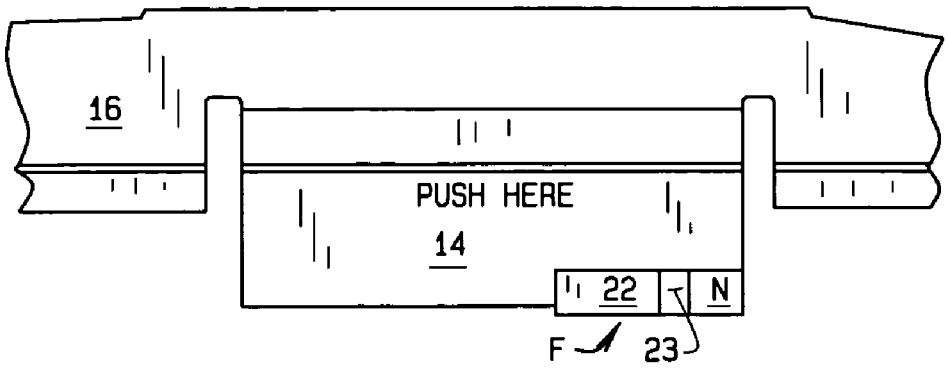
FIG. 5 is an elevation view of a child resistant cover tab.

As shown in FIGS. 4*a*–4*c*, tab 14 has a flange F extending outwardly from the base of the tab. When container C is to be closed, cover 12 is placed down over the top of pail 10 and turned or rotated until the cover is screwed tightly down over the pail. As cover 12 is screwed down, a leading edge 22 of a flange F contacts one of the tabs 18. As shown in FIGS. 4*a*–4*e*, the pail tab is of a triangular configuration having an angled leading edge 18*a*, and a straight trailing edge 18*b*. Rotation of cover 12 to screw it onto the top of pail 10 is from right to left as viewed in FIGS. 4*a*–4*e*. When leading edge 22 of flange F contacts edge 18*a* of tab 18 as shown in FIG. 4*a*, tab 14 is forced inwardly as the cover continues to be turned. Leading edge 22 of the tab is an angled surface which promotes inward deflection of tab 14. In addition, as shown in FIG. 5, a recess W extends across the top of tab 14 forming a line of weakness which acts as a flex point for the tab.

In FIG. 4*b*, tab 14 is shown being flexed so that the backside of the tab presses against a rib R extending outwardly from the side of pail 10. The rib limits the extent to which tab 14 is pressed inwardly. At this point, leading edge 22 of tab 14 changes to a flat spot 23 which rides over the tip of tab 18 as tab 14 slides past tab 18. Immediately past surface 23 of the flange a recess N is formed in the flange. As shown in FIG. 4*c*, when flat spot 23 moves past the tip of tab 18, tab 14 flexes outwardly away from rib R with tab 18 now being captured in recess N. Recess N provides a 1/32"–3/16" spacing for the tab. This allows the user to continue turning cover 12 so he or she is sure tab 14 has been moved past tab 18.

Once the cover is in place, it can be removed by turning it in the opposite direction, while at the same time pressing tab 14 inwardly so tab 18 is clear of recess N. This is as shown in FIG. 4*d*. Otherwise, one must try to force the flange portion of tab 14 past locking tab 18. Small children typically lack the understanding and/or dexterity to depress tab 14 inwardly while rotating cover 12. They also do not have enough strength to force flange F past tab 18. Neither do adults. Accordingly, tab 14 renders the container child proof as well as tamper resistant.

Figure 6A:
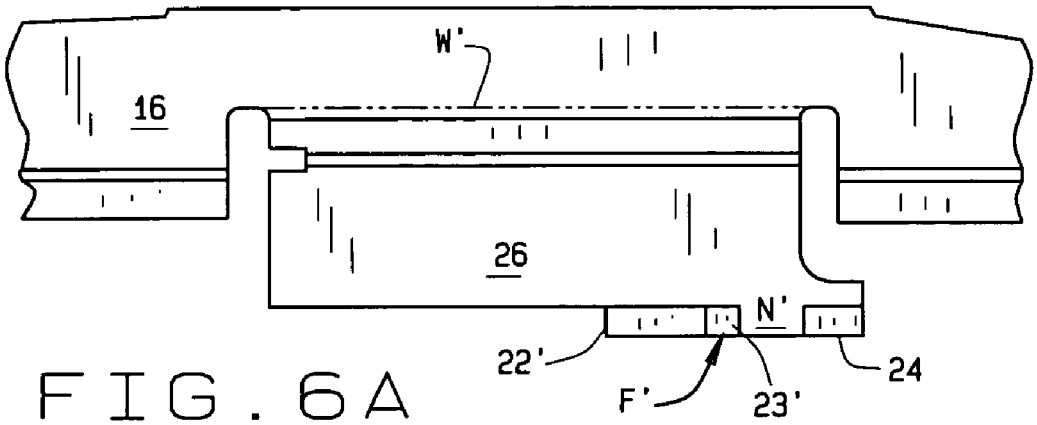
FIG. 6*a* is a partial elevation of the cover with the tamper evident tab.
Figure 6B:
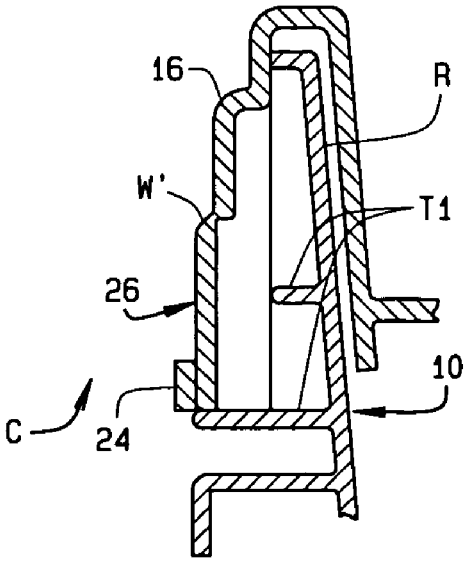
FIG. 6*b* is a sectional view of the cover and pail with the tamper evident tab in place.

Importantly, the present invention also utilizes the combination of child resistant cover tab 14 and the pail tab 18 to make container C tamper resistant, but further includes a tamper evident cover tab 26 for this purpose. This aspect of the present invention is accomplished by having at least one, and preferably two or more of tamper evident tabs 26 spaced about cover skirt 16. As with tab 14, the tamper evident tabs 26 are integrally formed with cover 12 as part of skirt 16. In FIGS. 6*a* and 6*b*, tamper evident cover tab 26 is shown to be generally identical to child resistant cover tab 14. As such, tab 26 has a flange F' extending outwardly from the base of the tab. Flange F' includes a tapered leading edge 22' with a flat spot 23' immediately behind it. However, recess N' comprises a notch formed between flat spot 23' and an outwardly extending section 24 formed immediately behind the recess. Locking in place of tab 26 is shown in FIG. 4*e*. In addition, as shown in FIG. 6, a recess W' extends across the top of tab 26. Besides forming a line of weakness which acts as a flex point for the tab when cover 12 is being installed on pail 11, the recess further provides a membrane for tearing the tabs 26 off of cover 12, as described hereinafter. Also, on the tamper evident tab or tabs only, the depth of the tab is greater than the gap between the pail tab 18 and pail rib R. The tamper evident cover tabs 26 make container C tamper resistant because it is physically difficult or impossible for one person to depress three or more cover tabs (i.e. one child resistant cover tab 14 and two or more tamper evident cover tabs 26) while simultaneously rotating the cover 12 in the direction to remove the cover. Coupled with this is the tab depth which, as noted above, is greater than the gap in the pail. This makes it very difficult to turn the cover back in the reverse direction, even by two people, and even if only one tamper evident tab is present. It will be understood by those skilled in the art that the torque required for initial installation of the cover is greater than would otherwise be expected, but the cover is installed at the factory using automated equipment, this is not a problem for the consumer. Opening container C, with these tamper evident features, might be accomplished by a person with large hands who can hold pail 10 between his or her legs to keep the pail from rotating with the cover while attempting to remove the cover. Removal of the cover might also be accomplished by two people acting in concert. In the store environment, however, either action would be somewhat obvious and suspicious. Additional protection from circumvention of the tamper evident and tamper resistant features of the invention is provided by a section 24. This section prevents the tamper evident tabs from being manipulated (pulled and/or twisted) through the gap in the pail. It will be understood by those skilled in the art that the height, width, and depth of this section are important design considerations in making the invention work.

Once container 10 has been purchased (unopened and with the correct contents), the consumer will want to open it. This is accomplished by first tearing off all of the tamper evident cover tabs 26 from cover 12. Then, pail 10 and cover 12 combination will be left with only the child resistant feature of the present invention provided by child resistant cover tab 14. An adult can then easily remove the cover as previously described and shown in FIG. 4*d*. However, a child does not have either the knowledge or strength to simultaneously press in on tab 14 to disengage it from its associated locking tab 18, while turning cover 12.

Each tamper evident cover tab 26 is connected to cover 12 by the thin membrane provided by the recess W'. Depending on the thickness of the recess, the tamper evident cover tabs 26 can be made to be more or less easily torn from the cover 12 so that a hand tool, such as a pliers, might be required. If any of the tamper evident cover tabs 26 has been removed from cover 12, it is evidence an attempt was made to open container C. The fact the tamper evident cover tabs 26 must be removed in order to open the container provides the evidence of tampering.

In one embodiment of the invention, cover 12 is made of a resilient material such as an injection molded plastic. The cover threads are molded integrally with the rest of the cover in a mold having a rotating core or cavity, all as is known to one of ordinary skill in the art. Child resistant cover tab 14 is formed using conventional slides in the cavity to provide vertical separation between the leading and trailing edges of the tab and cover skirt 16. Tamper evident cover tabs 26 are constructed using slides. Pail 10 is molded including slides which to strengthening ribs R as well as forming the tabs 18.

In view of the above, it will be seen that the several objects and advantages of the present invention have been achieved and other advantageous results have been obtained.

What is claimed is:

1. A child proof and tamper evident container comprising:

a pail having a threaded opening at its upper end;

a screw top cover correspondingly threaded for the cover to be screwed onto the top of the pail to enclose contents of the pail;

latching means formed on the pail for engaging the cover to the pail;

a first tab means including at least three tabs integrally formed with the cover for providing an indication as to whether or not the contents of the container have been tampered with, the first tab means engaging the latch means when the cover is on the pail and the first tab means being detached from the cover before a first use, or after sale of the container;

a second tab means also including at least one tab integrally formed with the cover for preventing a child from removing the cover and opening the container, the second tab means remaining attached to the cover throughout use of the container, and the second tab means also engaging the latch means when the cover is on the pail, a child not being sufficiently strong to disengage the second tab from the latch means whereby the child is prevented from opening the container, and the tabs comprising the respective first and second tab means all being and equidistantly spaced about the cover;

the latching means including a plurality of locking tabs one for engaging each of the first and second tabs, the locking tabs being formed around a rim of the pail with the same spacing as that of the tabs comprising the first and second tab means; and, each tab comprising the first and second tab means having a flange extending outwardly from the base of the respective tab for a leading edge of the flange to contact one of the locking tabs so to force the respective tab inwardly as the cover is turned past the locking tab.

2. The container of claim 1 wherein each tab comprising the first and second tab means has a recess extending across the top of the respective tab and forming a line of weakness which acts as a flex point for the respective tab by which the respective tab flexes inwardly when the flange contacts the locking tab.

3. The container of claim 2 wherein each tab comprising the first and second tab means has a recess formed in the flange so when the leading edge of the flange passes the locking tab, the respective tab of the first or second tab means flexes outwardly for the locking tab to be captured in the recess, removal of the cover now requiring the cover to be turned in the opposite direction while simultaneously pressing each tab of the first and second tab means inwardly so its associated locking tab clears the recess formed in the flange.

4. The container of claim 3 wherein the recess formed on each tab comprising the first tab means forms a membrane by which the respective tab is torn off of the cover at the time of the first use or sale of the container, removal of the tabs comprising the first tab means prior to the first use or sale providing an indication of tampering with the contents of the container.

5. The container of claim 4 in which the tab comprising the second tab means remains attached to the cover so to provide a child proof container throughout the use of the container.

6. A child proof and tamper evident container comprising:

a pail having a threaded opening at its upper end;

a screw top cover correspondingly threaded for the cover to be screwed onto the top of the pail to enclose contents of the pail;

latching means formed on the pail for engaging the cover with the pail;

first and second tab means formed on the cover and engaging the latching means as the cover is screwed onto the pail, the first tab means providing an indication as to whether or not the contents of the container have been tampered with, and the second tab means preventing a child from removing the cover and opening the container, the first and second tab means each including at least one tab integrally formed with the cover;

the latching means including a plurality of locking tabs one for engaging the first and second tab means, the locking tabs being formed around a rim of the pail with the same spacing as that of the tabs comprising the first and second tab means, and each locking tab have a triangular shape when viewed in plan with an angled leading edge and a straight trailing edge;

the tabs of the first and second tab means each having a flange extending outwardly from the base thereof for a leading edge of the flange to contact one of the locking tabs so to force the tab of the first or second tab means inwardly as the cover is turned past the locking tab, each tab of the first and second tab means having a recess extending across the top thereof and forming a line of weakness which acts as a flex point for the tab by which the respective tab flexes inwardly when the flange contacts the locking tab; and, each tab of the first and second tab means further having a recess formed in the flange so when the leading edge of the flange passes one of said locking tabs, the respective tab of the first or second tab means flexes outwardly for the locking tab to be captured in the recess, removal of the cover now requiring the cover to be turned in the opposite direction while simultaneously pressing each tab of the first and second tab means inwardly so its associated locking tab clears the recess formed in the flange.

7. The container of claim 6 wherein the first tab means is removable from the cover after a first use or sale of the container.

8. The container of claim 7 in which the first tab and second tab means each include tabs integrally formed with the cover, the tabs being equidistantly spaced about the cover.

9. The container of claim 6 wherein the recess formed on each tab of the first tab means forms a membrane by which each said tab is torn off of the cover at the time of the first use or sale of the container, removal of a said tab prior to the first use or sale providing an indication of tampering with the contents of the container.

10. The container of claim 6 in which the tabs of the second tab means remains attached to the cover so to provide a child proof container throughout the use of the container.

* * * * *